US006223354B1

(12) United States Patent
Carothers

(10) Patent No.: US 6,223,354 B1
(45) Date of Patent: May 1, 2001

(54) GOLF GLOVE WITH ELASTIC CLUB GRIPPING STRAP

(76) Inventor: Kevin Carothers, 1122 Jackson St., Dallas, TX (US) 75202

( * ) Notice: Subject to any disclaimer, the term of this patent is extended or adjusted under 35 U.S.C. 154(b) by 0 days.

(21) Appl. No.: 09/391,883

(22) Filed: Sep. 7, 1999

(51) Int. Cl.[7] ..... A41D 19/00
(52) U.S. Cl. ..... 2/161.2; 473/205
(58) Field of Search ..... 2/16, 20, 159, 2/161.1, 161.2, 161.4, 161.5, 161.6, 163, 917; 473/205

(56) References Cited

U.S. PATENT DOCUMENTS 3,105,972 * 10/1963 Christopher ..... 2/159
3,559,212 * 2/1971 Skovron ..... 2/159
4,665,565 * 5/1987 Odom ..... 2/161
5,088,122 * 2/1992 O'Toole ..... 2/161
5,414,868 * 5/1995 Crawford ..... 2/160
5,462,280 * 10/1995 Dickerson ..... 273/187.2
5,542,126 * 8/1996 Harvanek ..... 2/161.2
5,644,795 * 7/1997 Landis et al. ..... 2/161.3
5,669,073 * 9/1997 Pellington ..... 2/161.2
5,704,065 * 1/1998 Feuerhake ..... 2/161.2
5,742,942 * 4/1998 Sykes ..... 2/161.4
5,845,374 * 12/1998 Briggs ..... 24/442

* cited by examiner

*Primary Examiner*—John J. Calvert
*Assistant Examiner*—Katherine Moran
(74) *Attorney, Agent, or Firm*—John M. Brandt

(57) ABSTRACT

A golf glove for promotion and securing the proper grip of a golf glove consisting of a five fingered glove and an elastic strip, one end of the strap arranged to be removably attached to the knuckle portion of the back of the glove and the other end arranged to be removably attached to the base of the thumb portion of the palm side of the glove, the strap, in use, to be stretched over the little, middle, and ring fingers of the glove and diagonally across the palm.

5 Claims, 5 Drawing Sheets

GOLF GLOVE WITH ELASTIC CLUB GRIPPING STRAP

BACKGROUND OF THE INVENTION

1. Field of the Invention

The invention resides in the field of golf gloves and more particularly relates to gloves with straps to promote the proper grip of a golf cub.

2. Description of the Prior Art

A plurality of gloves designed to assist the user in the gripping of a golf club exist in the prior art. Various theories of what is an appropriate grip and the means of achieving the same are described in detail. Different arrangements of straps for assisting the grip and their means of attachment are presented for example in U.S. Pat. Nos. 4,796,306; Mitchell; 5,033,120, Myers; 5,088,122, O'toole; 5,669,073, Pellington; and 5,742,942, Sykes; and references contained therein.

The present invention is an improved combination of glove, glove markings, and strap utilizing Velcro hook and loop attachment means in a position and manner not heretofore disclosed in the prior art known to applicant.

SUMMARY OF THE INVENTION

The invention may be summarized as an improved golf glove to be worn on the weaker hand to assist the user in proper club grip placement and to apply the proper club grip pressure. The glove further functions to maintain a continued grip connection the throughout the swing from addressing the ball, through the swing to the final contact.

The invention consists of a five fingered glove and an elastic strap attachable at each end to a particular portion of the glove by the use of the Velcro hook and loop fastening system The first end is arranged to be secured to the back of the glove along the knuckles at the base of the little, ring, and middle finger portion and the opposite end secured to the palm at the base of the thumb portion. The width of the strap is approximately equal to the above mentioned three fingers and in use is stretched over these fingers, as they grip a club, then across the palm and to the base of the thumb.

The size of the mating Velcro hook and loop strips at the knuckle end of the glove and strip are approximately equal and of sufficient height and width to provide a secure attachment which will withstand the stretching pressure of the strap. The length of the Velcro strip on the opposite end of the strap may optionally be larger than that of the thumb portion of the glove to provide a variable grip pressure according to how tight or far the strap is stretched.

Additionally the glove may have printed thereon certain marked areas which indicate the appropriate placement of the golf club in the hand prior to gripping. These may include areas on both the back and palm of the glove and in particular may constitute an additional layer of fabric on the palm side.

These and other features and advantages of the invention will be filler understood from the drawings and description of the preferred embodiment which follows.

DESCRIPTION OF THE PREFERRED EMBODIMENT

Figure 1:
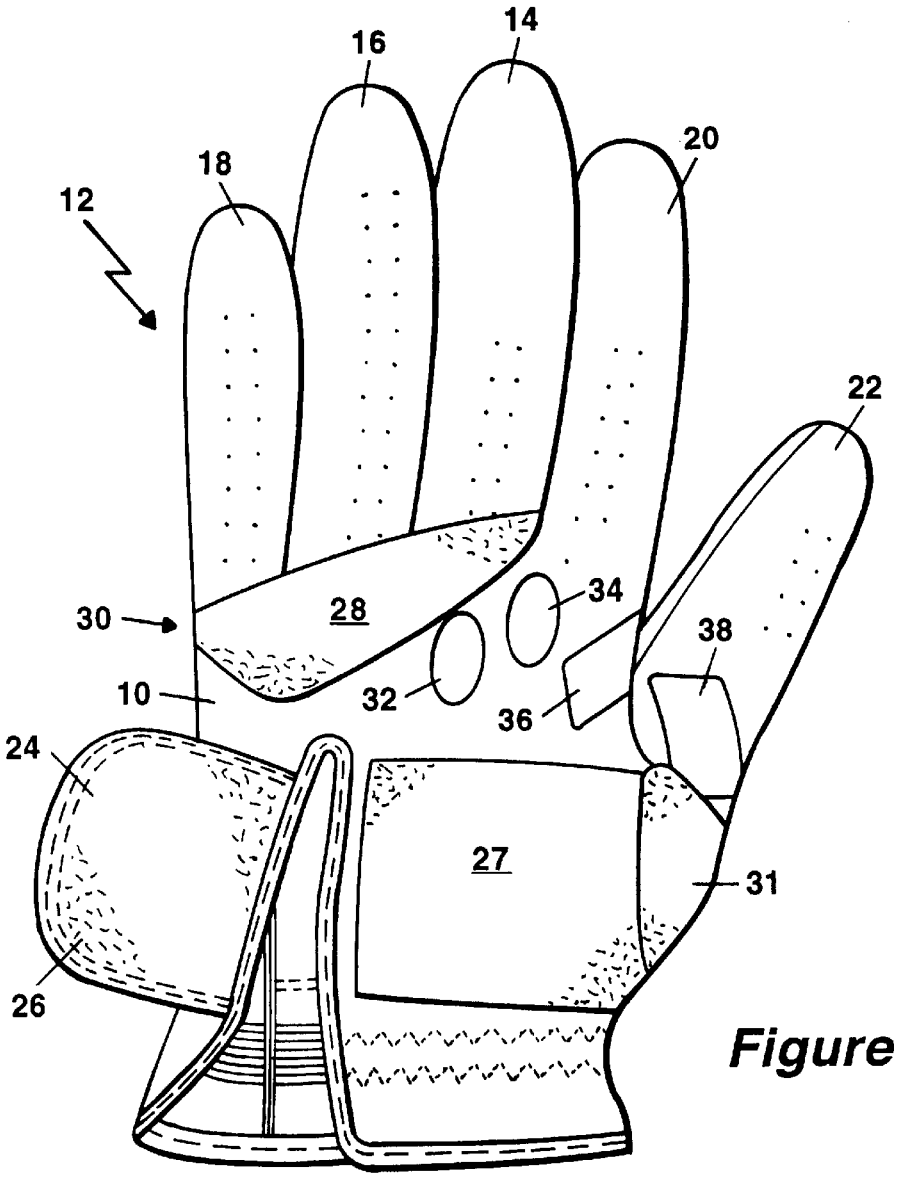
FIG. 1 is a plan view of the back side of the glove of the preferred embodiment of the invention

Referring first to FIG. 1 a plan view of the backside of a glove of the preferred embodiment is shown including a back of the hand covering portion 10, a finger portion 12 consisting of middle, ring, and little finger covering portions 14, 16, and 18 respectively, and index finger covering portion 20, and a thumb covering portion 22.

The glove, illustrated as a left handed glove, is secured on the hand by closing wrist flap 24 having a panel of one half of a Velcro hook and loop fastening system against a mating panel 26 attached to portion 10 supporting the opposite half of the fastening system.

A strip 28 comprised of one half of a Velcro hook and loop fastening system is attached to portion 10 across knuckle portion 30 and adjacent the base of finger portion 12. An additional strip 31 comprised of one half of a Velcro hook and loop fastening system is attached to the back of thumb covering portion 22. The purpose of strips 28 and 31 is to provide an attachment means for an elastic strap described below.

As will further be described below index marked areas 32, 34, and 36, 38 provide a means for properly aligning the handle of the club for a correct grip.

Figure 2:
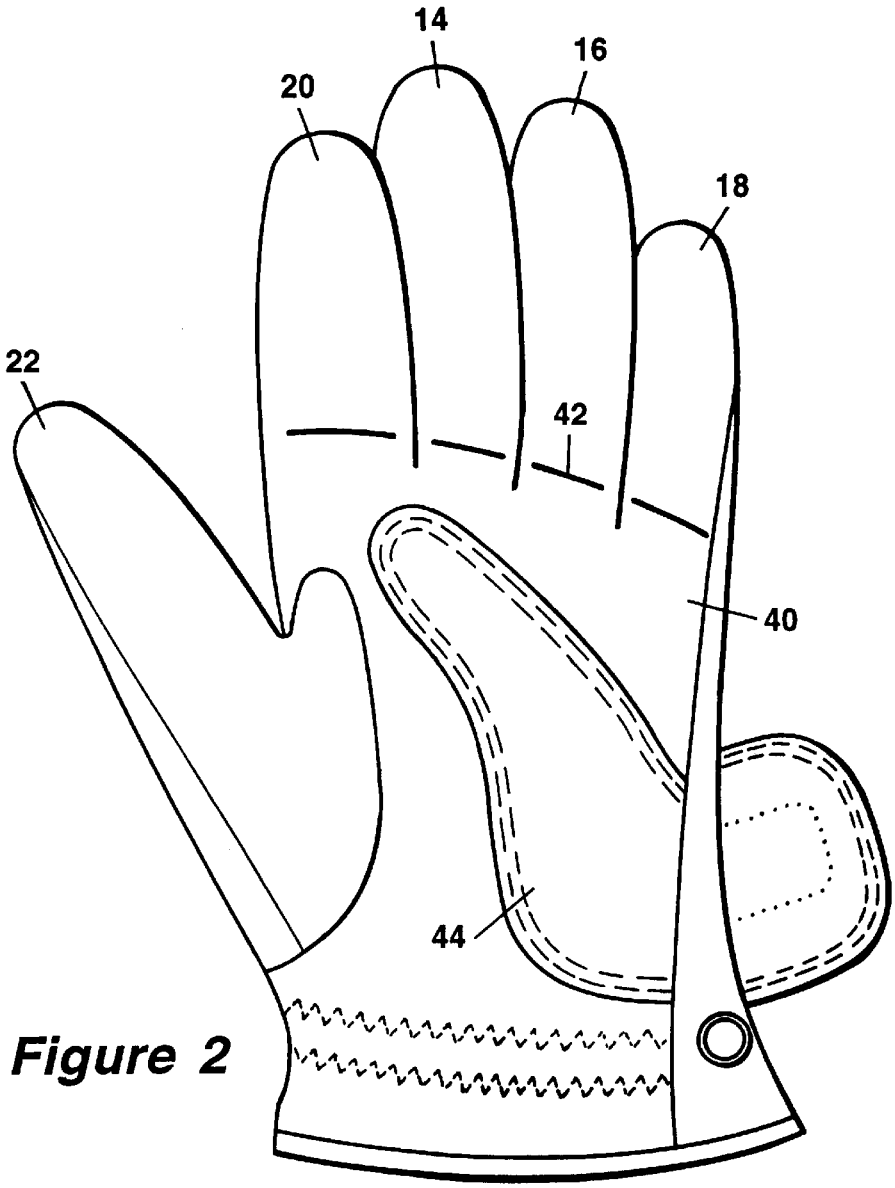
FIG. 2 is a plan view of the palm side of the glove of FIG. 1.

FIG. 2 is a plan view of the palm side of the glove of the FIG. 1 showing palm portion 40. Like numbers refer to like parts of the previous description. In addition line 42 traversing the base of finger portion 12 and area 44, optionally comprised of a separate panel of material and of distinguishable color from the rest of the glove, also provide a means for properly aligning the handle of the club for a correct grip.

Figure 4:
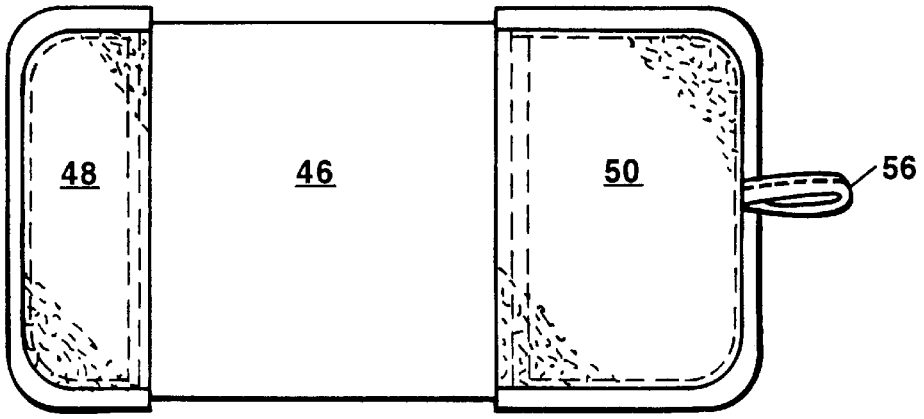
FIG. 4 is a plan view of the underside of an additional component of the invention.
Figure 5:
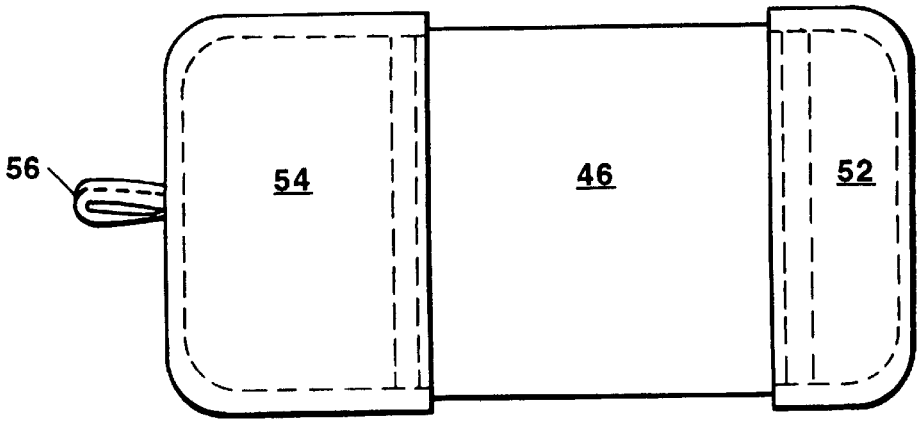
FIG. 5 is a plan view of the topside of the component of FIG. 4.
Figure 3:
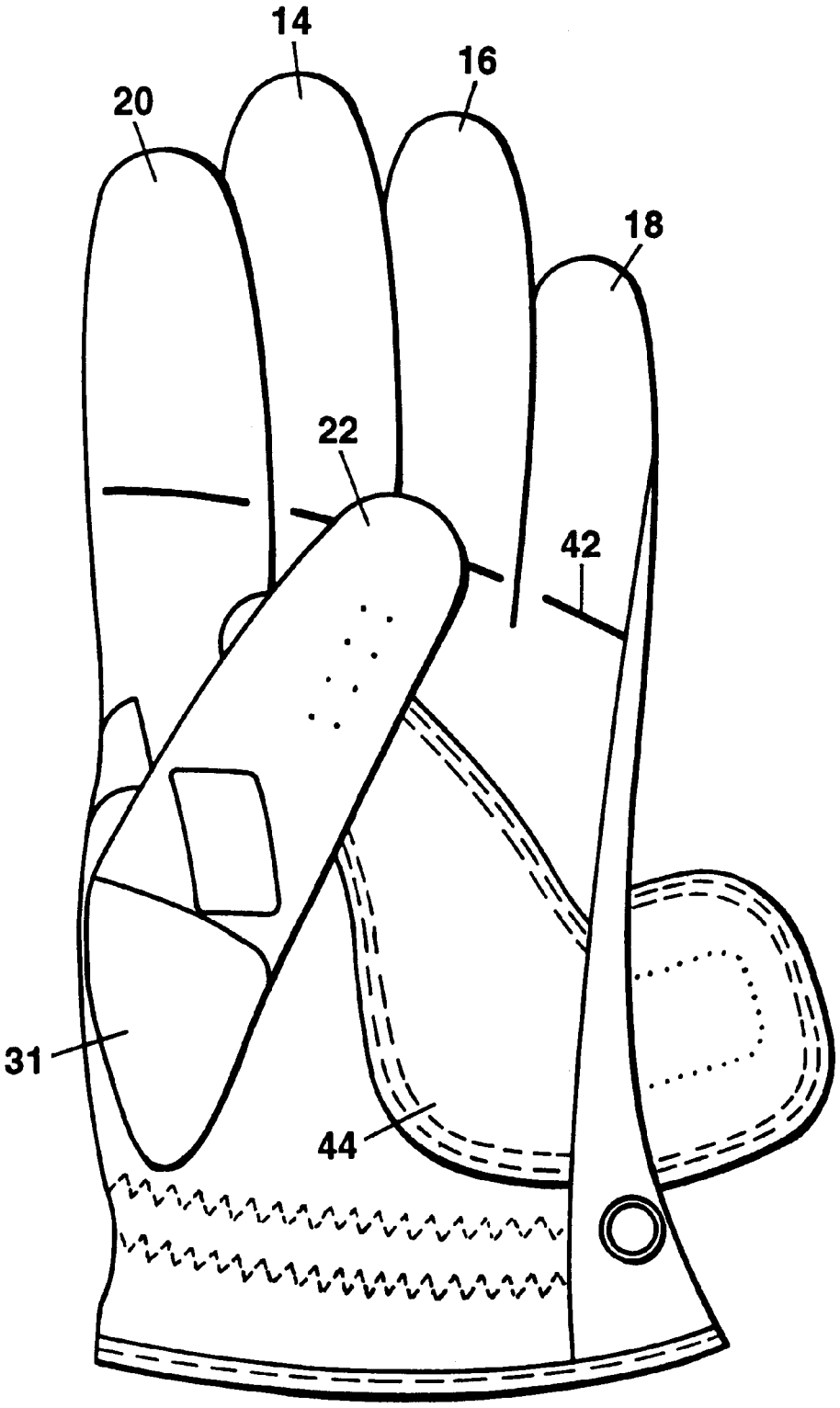
FIG. 3 is an additional view of FIG. 2 showing the thumb portion in an alternate position.

FIG. 3 illustrates the palm side of FIG. 2 with thumb portion 22 turned inward to palm portion 40 as it will be when worn. FIG. 4 illustrates an elastic strap 46 having a strip of one half of a Velcro fastening system disposed at opposite ends. Strip 48 is the opposite half of that of strip 28 and strip 50 is the opposite half of that of strip 31. In use strip 48 is attached to strip 28 across knuckle portion 30 and strip 50 is attached to strip 31 across thumb portion 22. FIG. 5 shows the topside of the elastic strip. Panels 52 and 54 provide support for strips 48 and 50 respectively. Loop 56 provides a means to grip the end of strap 46 to pull it over the hand as will be described below.

Figure 6:
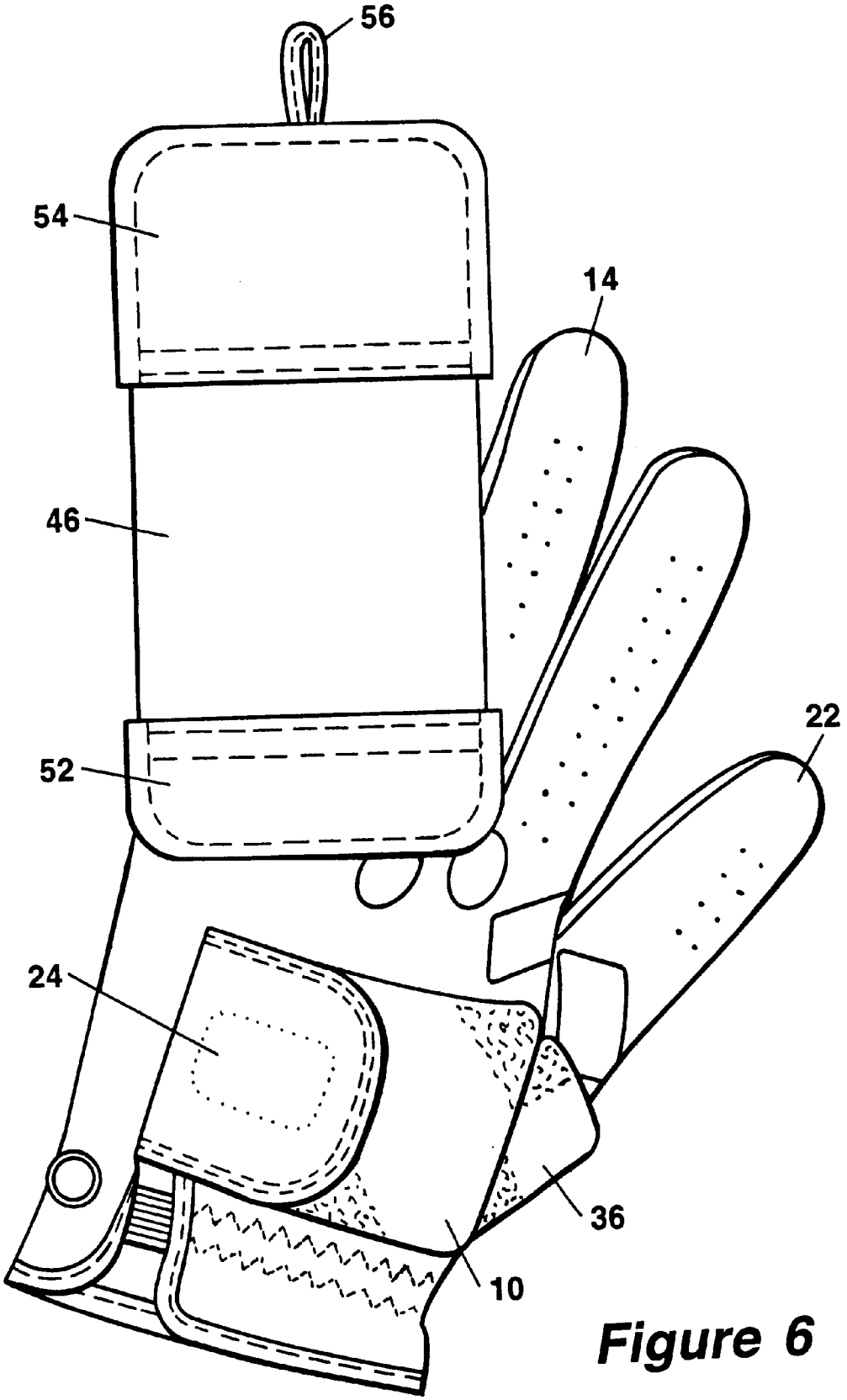
FIG. 6 is a plan view of the back side of the glove of FIG. 1 with the component of FIG. 4 attached.
Figure 7:
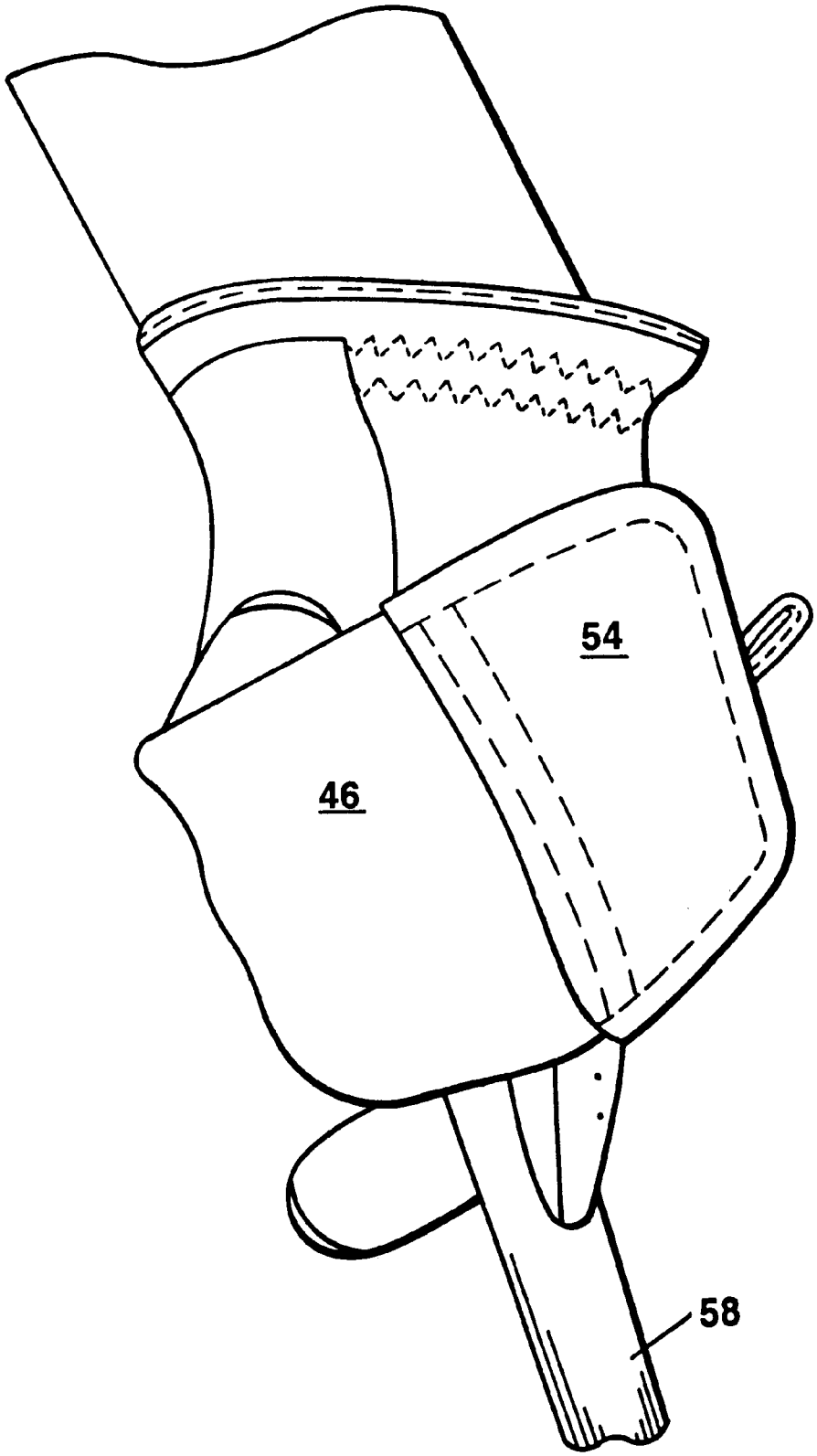
FIG. 7 is a perspective front view of the glove of the invention in use.

FIG. 6 illustrates the mutual position of the glove and strap 46 with strap 46 attached to knuckle portion 30 at the back of the glove by the mating Velcro hook and loop strips, as heretofore described, in preparation for use. The glove is then placed on the hand and club 58 grasped in alignment with the above described marked areas as shown in FIG. 7. Strap 46 is then stretched over the finger section, down across the palm and attached to thumb portion 22 by the mating Velcro strips as heretofore described. As will be seen the tightness of the grip resulting form the amount of stretch of strap 46 may be adjusted by the relative position of strips 31 on the glove and 50 on the strap.

As variations in the above disclosure will now become apparent to those skilled in the art, the invention is hereby defined by the following claims.

What is claimed is:

1. A golf glove for promoting and securing the proper grip of a golf club comprising in combination:

a. a five fingered golf glove having a palm side, a back side, a thumb portion and a middle, ring, and little finger portion;

b. an elastic strap of a width approximately equal to the width of said middle, ring, and little finger portion; said strap arranged to be stretched over said finger portion and across said palm;

c. a first strip of one half of a hook and loop fastening system disposed across said backside of said glove across the knuckle portion and adjacent the base of said middle, ring, and little finger portion; and of a length approximately equal to said base of said finger portion;

d. a second strip of the opposite half of said hook and loop fastening system disposed at one end of said elastic strap; said second strip of a length approximately equal to said first strip;

e. a third strip of one half of a hook and loop fastening system disposed on the back side of said glove at the base of the thumb portion; and f. a fourth strip of the opposite half of said hook and loop fastening system disposed at the opposite end of said elastic strap said fourth strip of a length approximately equal to that of said third strip whereby when said elastic strap is attached at said knuckle portion and stretched over said finger portion and across said palm and attached at said base of said thumb portion, a golf club will be properly positioned and securely griped in the hand of the user.

2. The glove of claim 1 wherein said fourth strip is of a width greater than said third strip whereby the pressure of the glove and the hand on said club may be varied by the relative attached position of said third and fourth strips.

3. The glove of claim 1 further including at least one marked area on said palm side of said glove, said area arranged to define the proper alignment and positioning of said club when gripped by said hand.

4. The glove of claim 3 wherein said marked area comprises a layer of fabric attached to said glove.

5. The glove of claim 2 further including at least one additional marked area on said back side of said glove, said additional area arranged to define the proper alignment and positioning of said club when gripped by said hand.

* * * * *